US010111497B2

(12) United States Patent
Hayashi et al.

(10) Patent No.: US 10,111,497 B2
(45) Date of Patent: Oct. 30, 2018

(54) BUTTON BACK AND BUTTON

(71) Applicant: YKK Corporation, Tokyo (JP)

(72) Inventors: Daisuke Hayashi, Toyama (JP); Noboru Shimizu, Toyama (JP); Takuto Ogushi, Toyama (JP); Akio Kobayashi, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/555,988

(22) PCT Filed: Jun. 23, 2015

(86) PCT No.: PCT/JP2015/068100
§ 371 (c)(1),
(2) Date: Sep. 6, 2017

(87) PCT Pub. No.: WO2016/207984
PCT Pub. Date: Dec. 29, 2016

(65) Prior Publication Data

US 2018/0055151 A1 Mar. 1, 2018

(51) Int. Cl.
*A44B 1/02* (2006.01)
*A44B 1/28* (2006.01)

(52) U.S. Cl.
CPC . *A44B 1/02* (2013.01); *A44B 1/28* (2013.01)

(58) Field of Classification Search
CPC .... A44B 1/02; A44B 1/28; A44B 1/08; A44B 1/44; Y10T 24/3613; Y10T 24/3611;
(Continued)

(56) References Cited

U.S. PATENT DOCUMENTS 576,186 A * 2/1897 Cary ..... A44B 1/28 24/90.1
1,521,431 A 12/1924 Carley
(Continued)

FOREIGN PATENT DOCUMENTS

JP 061009/1983 4/1983
JP 166711/1984 11/1984

OTHER PUBLICATIONS

International Search Report, PCT Patent Application No. PCT/JP2015/068100, dated Sep. 15, 2015.
(Continued)

*Primary Examiner* — Robert Sandy
*Assistant Examiner* — Rowland Do
(74) *Attorney, Agent, or Firm* — Kilpatrick Townsend & Stockton LLP

(57) ABSTRACT

A button back which makes it possible to form the front surface of a button to be a circular shape; a shell cap hard to be rotated; and an umbrella part hard to be deformed. The button back is made of metal, including a cylindrical part and an umbrella part extending radially outward from one axial end of the cylindrical part. The umbrella part includes a first bending part which extends radially outward from the one axial end of the cylindrical part and then bends on the opposite side of the cylindrical part. An outer periphery, including a radially outer end, of the first bending part has a polygonal shape including at least three corners and sides which extend between two circumferentially adjacent corners. The umbrella part includes flat plates extending radially outward from the radially outer end, corresponding to the sides, of the first bending part.

11 Claims, 10 Drawing Sheets

(58) Field of Classification Search
CPC ..... Y10T 24/3683; Y10T 24/3615; Y10T 24/3657; Y10T 24/366; Y10T 24/3672
See application file for complete search history.

(56) References Cited

U.S. PATENT DOCUMENTS

| | | | | | |
|---|---|---|---|---|---|
| 3,341,905 | A | * | 9/1967 | Gill | A44B 1/28 24/105 |
| 4,512,063 | A | * | 4/1985 | Fukuroi | A44B 1/44 24/113 R |
| 4,570,307 | A | | 2/1986 | Kanzaka | |
| 4,571,780 | A | * | 2/1986 | Fukuroi | A44B 1/44 24/114.4 |
| 4,815,173 | A | * | 3/1989 | Watanabe | A44B 1/44 24/113 R |
| 4,928,362 | A | * | 5/1990 | Collas | A44B 1/08 24/114.05 |
| 2007/0226959 | A1 | | 11/2007 | Kitano | |

OTHER PUBLICATIONS

International Preliminary Report on Patentability, PCT Patent Application No. PCT/JP2015/068100, dated Jan. 4, 2018.

* cited by examiner

BUTTON BACK AND BUTTON

This application is a national stage application of PCT/JP2015/068100, which is incorporated herein by reference.

TECHNICAL FIELD

This invention relates to a button back and a button, and more particularly to a button back that is commonly used for jeans, etc. and a button using such a button back.

BACKGROUND ART

As a button that is commonly used for jeans, jean jacket, etc., a type of a button is known, which has a generally cylindrical barrel and a head expanding in a disk form at one end of the barrel, wherein the head is taken in and out through a buttonhole. Such a button is disclosed in, for example, US Patent Application Publication No. 2007/0226959 (Patent Document 1). This type of button comprises three parts, namely, a button back and a shell cap, which are metallic outer shell parts and an insert, which is a resin or metallic core part. The button back comprises a cylindrical part defining a periphery wall of the barrel of the button and an umbrella part extending radially outward from one end of the cylindrical part, defining a back side wall of the head of the button. Generally, a radially outward end portion of the umbrella part is pressed so as to bend on the opposite side of the cylindrical part. Thereby, the umbrella part is given a thickness for a part of the insert corresponding to the head to be placed, and the strength of the umbrella part is increased. The shell cap comprises a disk part defining a front side wall of the head of the button and a bending part which is bent from the radially outward end of the disk part on the back side of the head. The bending part is deformed to be attached a curved, radially outward end portion of the umbrella part of the button back. The front surface of the disk part of the shell cap becomes the front surface of the head of the button, and generally onto this surface, logos or designs are added, which comprise characters, figures, symbols or the like with orientations thereof in the circumferential direction have been set. Such a button is mounted to jeans or the like with the predetermined orientation.

If a shell cap with an oriented logo or the like on the surface as mentioned above is rotated, namely circumferentially displaced with respect to the umbrella part of a button back after the shell cap was attached to the umbrella part, then the logo or the like is displaced from the predetermined orientation. Further, even if a shell cap has no orientation, it is not preferable that the shell cap can be rotated in use from the aspect of product quality. To prevent such a shell cap from being rotated, the Patent Document 1 suggests that the outer periphery of an umbrella part of a button back is formed in a polygonal shape (see FIG. 9 of the document) in order to make the corners of the polygonal shape work as resistances to rotating of the shell cap. In this case, however, there is a problem that it is hard to form the front surface of the button to be a beautiful circle since the bending part of the shell cap is deformed along the polygonal shape of the umbrella part.

As another button back having a function of preventing the shell cap from rotating, one is known in which a plurality of bumps are circumferentially provided on a curved, radially outward end portion of the umbrella part as resistances to rotating of the shell cap. However, to form such bumps, a die becomes complicated, increasing production costs. Further, to reduce material costs of the button, button backs have been produced using aluminum or aluminum alloy instead of conventional brass, recently. In a case of a button back made of aluminum or aluminum alloy, even if the above-mentioned bumps are provided on the radially outward end portion of the umbrella part, the shell cap may rotate for the following reason. That is, the radially outward end portion itself of the umbrella part is easily deformed with the shell cap attached to the radially outward end portion, and when the umbrella part is deformed, the attachment force will be lowered, resulting in rotating of the shell cap.

CITATION LIST

Patent Literature

[PTL 1] WO2007/0226959

Solution of the Problem

Accordingly, an object of the present invention is to provide a button back, with which it would be possible to form the front surface of a button to be a beautiful circular shape; a shell cap would be hard to be rotated; and an umbrella part would be hard to be deformed, and to provide a button using such a button back.

SUMMARY OF INVENTION

To solve the above-mentioned problems, according to one aspect of the present invention, there is provided a metallic button back comprising a cylindrical part and an umbrella part extending radially outward from one axial end of the cylindrical part, wherein the umbrella part includes a first bending part which extends radially outward from the one axial end of the cylindrical part and then bends on the opposite side of the cylindrical part, wherein an outer periphery, including a radially outer end, of the first bending part has a polygonal shape including at least three corners and sides which extend between two circumferentially adjacent corners, wherein the umbrella part includes flat plates extending radially outward from the radially outer end, corresponding to the sides, of the first bending part.

In the invention, the button back is made of metal such as copper or copper alloy, aluminum or aluminum alloy, zinc or zinc alloy, nickel or nickel alloy, and the like, but not limited thereto. Further, as described later, the button back can be made of aluminum or aluminum alloy to reduce the cost of material.

The button back in accordance with the invention, the first bending part, the outer periphery of which becomes a polygonal shape including at least three corners and at least three sides, and the flat plates, which extend from the radially outer end of each of the sides, are provided in the umbrella part. With a combination of the bending part and the flat plates, it would be possible to enhance the strength or rigidity of the umbrella part. Thus, even if a button back is made of aluminum or aluminum alloy, which is more deformable than brass, it would be possible to make its umbrella part hard to be deformed. The first bending part can be a part bent in a curved manner, for example, but not limited thereto.

In an embodiment of the invention, the flat plates define a circumference of a perfect circle passing each of the corners. In this case, a radial length of each flat plate extending radially outward from the radially outer end of the first bending part is substantially zero at each of the corners and becomes longest at the circumferential midpoint of each of the sides, which is the midpoint between two circumferentially adjacent corners. In this embodiment, the radially outer end of the umbrella part of the button back forms a perfect circle by the flat plates. Thus, when a second bending part of the shell cap is attached to the radially outer end portion of the umbrella part of the button back, the second bending part of the shell cap can be bent in a perfect circular manner along the outer periphery of the flat plates. Thereby, the front surface of the button tends to be a beautiful circular shape.

The second bending part of the shell cap is deformed to contact of the first bending part of the umbrella part of the button back. Then, since there are the flat plates for the sides in the polygonal shape of the first bending part while there are substantially no flat plates for the corners, a degree of bending of the second bending part of the shell cap becomes smallest at each of the corners of the first bending part and largest at the circumferential midpoint of each of the sides. In this way, a degree of bending of the second bending part of the shell cap changes alternately in the circumferential direction with the corners and the sides, and thereby, the shell cap will be hard to be rotated with respect to the umbrella part.

In an embodiment of the invention, the outer periphery of the first bending part is a polygon with eight to twelve corners. It has been found through tests and the like that the optimal polygonal shape that contributes to enhance the strength or rigidity of the first bending part of the umbrella part is based on button sides as follows:

22L (The diameter of a completed button; L=0.635 mm): dodecagon

24L: octagon

27L: octagon

28L: octagon

30L: decagon

32L: decagon

In a case where the first bending part is between an octagon and a dodecagonal, at least the radially outer end portions of the corners and the sides of the first bending part are covered between the circle defined by the radially outer end of the flat plates of the umbrella part of the button back and the circle defined by the radially inner end of the second bending part of the shell cap after being attached to the first bending part of the umbrella part. Thereby, the shell cap can be securely attached.

In an embodiment, the first bending part has a curvature radius less than or equal to 1 mm. In the invention, the curvature radius of the first bending part can be set to be the same for both the corners and the sides. Lower limit of the curvature radius of the first bending part is the thickness of the first bending part, for example 0.3 mm. In this way, by making the bending of the first bending part relatively steep, the second bending part of the shell cap can be securely attached in comparison with relatively gentle bending of the first bending part. Further, in a case where the curvature radius of the first bending part is less than 0.1 mm, the corners of the first bending part contact the second bending part of the shell cap in a manner where each of the corners of the first bending part works as an edge, so it can be expected to increase an effect of preventing the shell cap from being rotated. If the curvature radius of the first bending part exceeds 0.1 mm, the second bending part of the shell cap would be bent more than necessary, or a gap between the attached second bending part and the first bending part would be too large. In the latter, the shell cap would be easily rotated with respect to the umbrella part.

In an embodiment, a length of each of the flat plates extending from the first bending part is longest at the midpoint of each of the sides and gradually reduced towards both corners at both ends of each of the sides. A length of each of the flat plates extending from each of the sides is a length in the direction perpendicular to the corresponding one of the sides. A length of each of the flat plates extending from each of the sides is longest at the midpoint of each of the sides (the circumferential midpoint of each side) and gradually reduced towards both corners at both ends of each of the sides.

In an embodiment, the button back is made of aluminum or aluminum alloy. By making the button back of aluminum or aluminum alloy, it would be possible to reduce material costs compared to brass and to make it hard to be deformed. Further, by providing the umbrella part with the first bending part having the polygonal, outer periphery and the flat plates extending from the radially outer end of each of the sides of the first bending part, it would be possible to enhance the strength or rigidity of the umbrella part and to increase an effect of preventing the shell cap from being rotated.

According to another aspect of the present invention, there is provided a metallic button including a metallic button back and a metallic shell cap, which is attached to the button back, wherein the button back comprises a cylindrical part and an umbrella part extending radially outward from one axial end of the cylindrical part, wherein the umbrella part includes a first bending part which extends radially outward from the one axial end of the cylindrical part and then bends on the opposite side of the cylindrical part, wherein an outer periphery, including a radially outer end, of the first bending part has a polygonal shape including at least three corners and sides which extend between two circumferentially adjacent corners, wherein the umbrella part includes flat plates extending radially outward from the radially outer end, corresponding to the sides, of the first bending part, wherein the shell cap comprises a disk part defining a front surface of the button and a second bending part, which is bent from the radially outward end of the disk part to be attached to a radially outer end portion of the umbrella part of the button back, wherein a degree of bending of the second bending part of the shell cap is greater in each of the sides of the first bending part than in each of the corners.

The button in accordance with the invention uses the button back in accordance with the aforementioned invention, and has a feature that a degree of bending of the second bending part of the shell cap is greater in each of the sides of the first bending part than in each of the corners. In this way, a degree of bending of the second bending part of the shell cap changes alternately in the circumferential direction with the corners and the sides, the sell cap will be hard to be rotated with respect to the button back.

In the invention, the button back is made of metal such as copper or copper alloy, aluminum or aluminum alloy, zinc or zinc alloy, nickel or nickel alloy, and the like, but not limited thereto.

In an embodiment, the flat plates define a circumference of a perfect circle passing each of the corners. In this case, a radial length of each flat plate extending radially outward from the radially outer end of the first bending part is substantially zero at each of the corners and becomes longest at the circumferential midpoint of each of the sides, which is the midpoint between two circumferentially adjacent corners. In this embodiment, the radially outer end of the umbrella part of the button back forms a perfect circle by the flat plates. Thus, when a second bending part of the shell cap is attached to the radially outer end portion of the umbrella part of the button back, the second bending part of the shell cap can be bent in a perfect circular manner along the outer periphery of the flat plates. Thereby, the front surface of the button tends to be a beautiful circular shape.

In an embodiment of the invention, attached states of the second bending part of the shell cap change alternately in the circumferential direction. That is, the bending part of the shell cap has different attached forms between in the portions of the bending part attached to the corners and in the portions attached to the sides. Such differences of attached forms are made alternately in the circumferential direction by the corners and the sides. Thereby, shell cap will be hard to be rotated with respect to the umbrella part of the button back.

In an embodiment of the invention, bending angles of the second bending part of the shell cap are different between in portions of the second bending part corresponding to the sides and in portions thereof corresponding to the corners, and wherein, in the portions corresponding to the sides, there is a gap between the second bending part and the sides.

In an embodiment of the invention, the first bending part includes vertical portion substantially parallel to the axial direction of the button back, the vertical portion extending to the radially outer end of the first bending part, and wherein the second bending part of the shell cap is at least partially in contact with the vertical portion. When the second bending part of the shell cap is deformed to be attached to the first bending part of the umbrella part of the button back, by making the second bending part at least partially in contact with the vertical portion of the first bending part, it is expected that the shell cap will be still harder to be rotated.

Advantageous Effects of Invention

In the invention, by providing the umbrella part with the first bending part having a polygonal outer periphery with three or more corners and sides and with the flat plates extending from the radially outer end of each of the sides of the first bending part, it would be possible to enhance the strength or rigidity of the umbrella part. Further, a degree of bending, bending angles, and attached forms of the first bending part of the shell cap change alternately in the circumferential direction with the corners and the sides. Thereby, the shell cap will be hard to be rotated with respect to the button back. Furthermore, when the flat plates has a perfect, circular circumference passing each of the corners, the radially outer end of the umbrella part of the button back becomes a perfect, circular shape by the flat plates. Thereby, when the second bending part of the shell cap is attached to a radially outer end portion of the umbrella part of the button back, the bending part of the shell cap can be bent in a perfect circular manner along the outer periphery of the flat plates. Thereby, the front surface of the button tends to be a beautiful circular shape.

DESCRIPTION OF EMBODIMENTS

Figure 1:
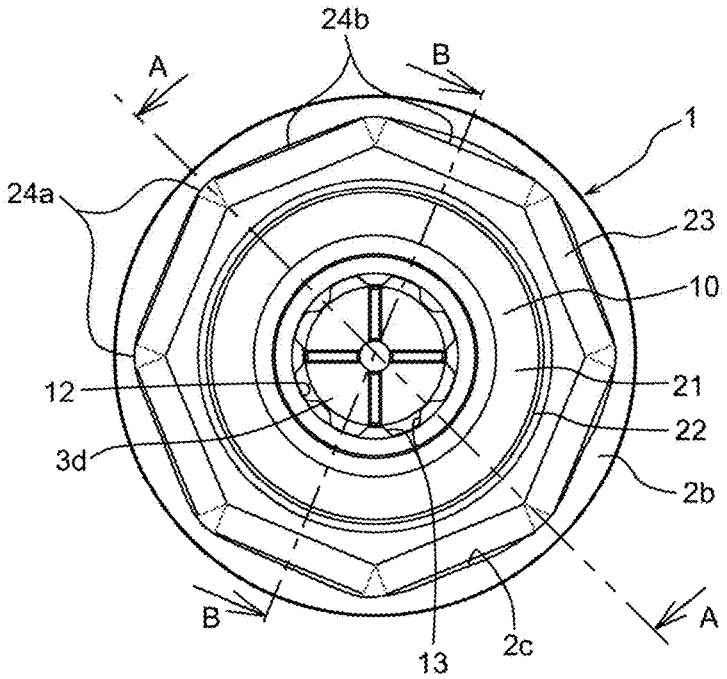
FIG. 1 shows a bottom view of a button in accordance with one embodiment of the invention.
Figure 2:
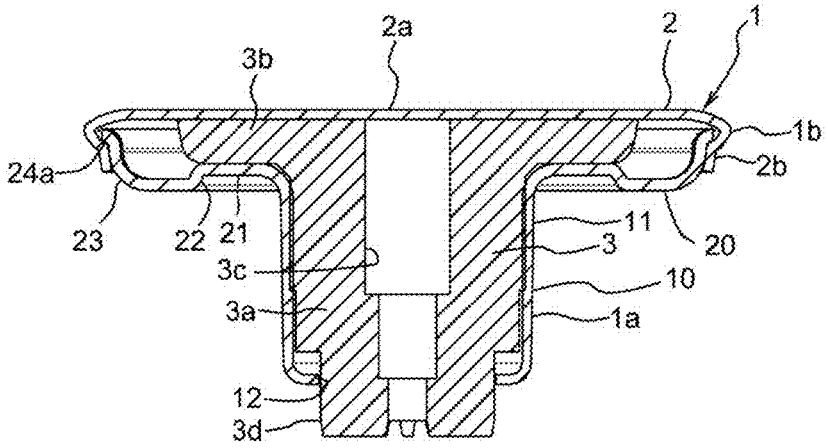
FIG. 2 shows a cross sectional view taken along A-A line in FIG. 1.
Figure 3:
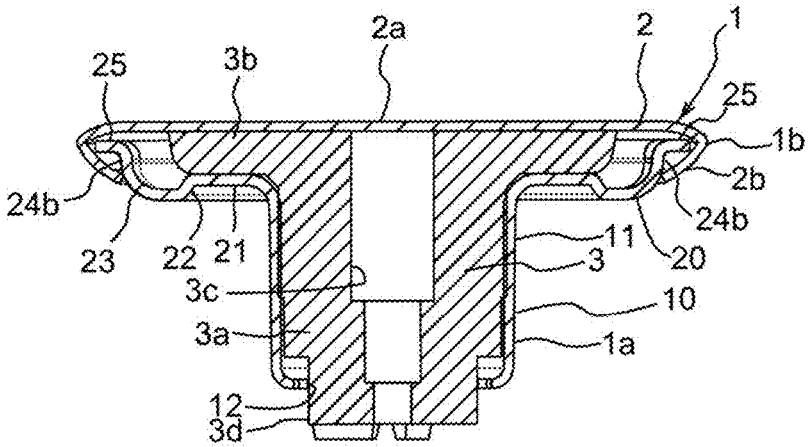
FIG. 3 shows a cross sectional view taken along B-B line in FIG. 1.

Hereinafter, a button back in accordance with an embodiment of the invention will be described with referring to the drawings. However, this invention is not limited to the embodiment, and it can be modified or altered within the scope of the invention and within the range of equivalents. FIG. 1 shows a bottom view of a button 1 in accordance with one embodiment of the invention. FIGS. 2 and 3 are cross sectional views taken along A-A line and B-B line in FIG. 1, respectively. In the following descriptions, the up-and-down direction is based on FIGS. 2 and 3, etc. The button 1, which is commonly used for jeans, etc., has a generally cylindrical barrel 1*a* and a head 1*b* expanding radially outward in a disk form on the upper end side of the barrel 1*a*. The button 1 is a type in which the head 1*b* is taken in and out through a buttonhole (not shown). The button comprises three parts, namely, a button back 10 and a shell cap 2, which are metallic outer shell parts and an insert 3, which is a resin or metallic core part. The button back 10 is in accordance with the invention. In this embodiment, as an example, the button back 10 is made of aluminum alloy; the shell cap 2 is made of brass; and the insert 3 is made of resin, but they are not limited thereto. The shell cap 2 comprises a disk part 2*a* defining a front surface of the button 1 and an annular second bending part 2*b* (hereinafter referred to simply as "bending part 2*b*"), which is bent downward from the radially outward end of the disk part 2*a*. The bending part 2*b* is to be attached to an umbrella part 20 as described later of the button back 10. Although not shown, onto an upper surface of the shell cap 2, namely, the front surface of the button 1, logos or designs are added, which comprise characters, figures, symbols or the like with orientations thereof in the circumferential direction. Thus, when the button 1 is mounted to a fabric, it is needed to arrange the logs, etc. in the predetermined orientation. The insert 3 comprises a cylindrical barrel core 3*a*, which is housed in the cylindrical part 11 of the button 1, a head core 3*b*, which radially expands from the barrel core 3*a* and is housed in the head 1*b*, and an engagement space 3*c*, which receives and then fixes a shank 32 of a button fastener 30 (see FIG. 10) as described later when the button 1 is mounted to a fabric. In the embodiment, the engagement space 3*c* is formed as a through-bore. The engagement space 3*c* is a space whose diameter is less than the diameter of the shank 32. The diameter of the engagement space 3*c* of the insert 3 expands at two stages from the bottom to the top, and the insert 3 has corresponding steps on the inner surface. The barrel core 3*a* includes, at its lower end portion, a small diameter portion 3*d*, which extends downward through an opening 12 of the cylindrical part 11 as mentioned later of the button back 3. Further, on the bottom surface of the small diameter portion 3*d*, a cross-shaped convexity is provided, which is convex downward.

Figure 4:
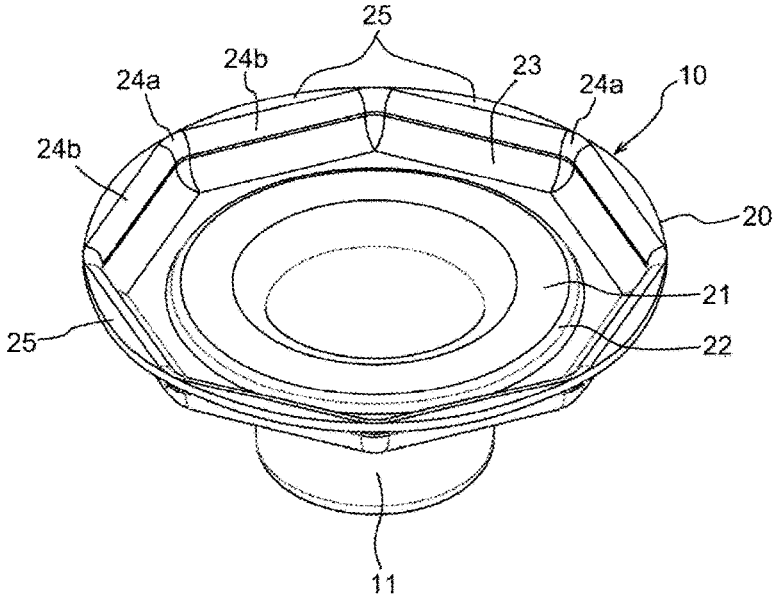
FIG. 4 shows a perspective view of the button back.
Figure 5:
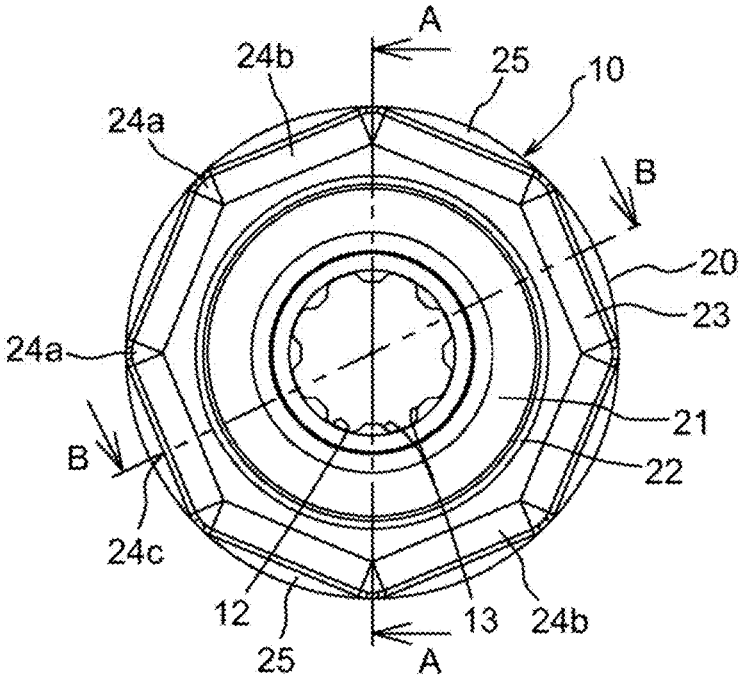
FIG. 5 shows a bottom view of the button back.
Figure 6:
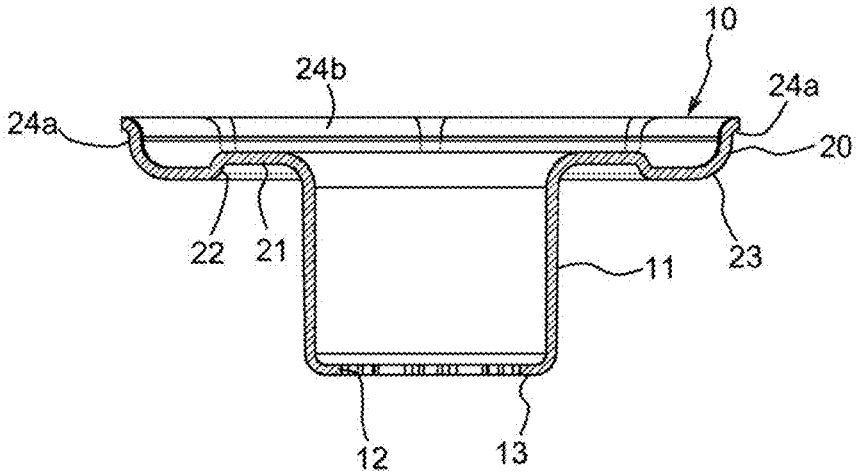
FIG. 6 shows a cross sectional view taken along A-A line in FIG. 5.
Figure 7:
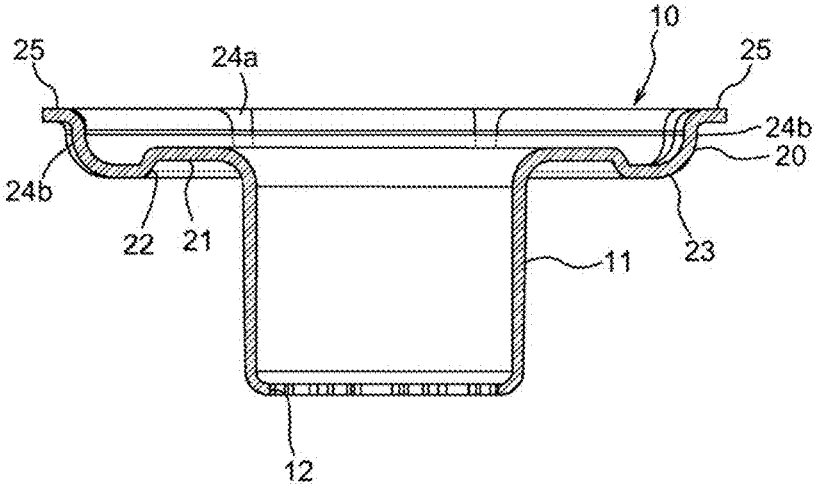
FIG. 7 shows a cross sectional view taken along B-B line in FIG. 5.

FIGS. 4 and 5 are perspective view and bottom view of the button back 10. FIGS. 6 and 7 are cross sectional views taken along A-A line and B-B line in FIG. 5. The button back 10 is formed by shaping a plate of aluminum or aluminum alloy having a thickness of about 3 mm. The button back 10 comprises a cylindrical part 11 defining a periphery wall of the barrel 1*a* of the button 1 and an umbrella part 20 extending radially outward from the upper end of the cylindrical part 20, defining a back side wall of the head 1*b* of the button 1. The cylindrical part 11 is open upward and has an opening 12 at the lower end. At the lower end of the cylindrical part 11, eight protrusions 13 slightly protruding radially outward in the circumferential direction are provided. With the protrusions 13. The diameter of the opening 12 is slightly reduced, and the small diameter portion 3*d* of the barrel core 3*a* of the insert 3 will extend downward through the reduced opening 12 by press fitting.

The umbrella part 20 comprises an annular base 21, which extends substantially horizontally ("horizontal" means a direction along any plane perpendicular to the axis of the cylindrical part 11) and radially outward from the upper end of the cylindrical part 11; an annular step 22, which slightly drops downward and radially outward from the radially outer end of the base 21; a bending part 23 as a first bending part, which extends substantially horizontally and radially outward from the lowest end of the step 22 and then curves upward; and flat plates 25, which further extend substantially horizontally, radially outward and partially from the radially outer end of the bending part 23. The curvature radius R1 of the bending part 23 is set in such a manner that R1 is less than or equal to 1 mm. Referring to the enlarged views of FIGS. 8 and 9, the bending part 23 includes a horizontal portion 23*a* extending substantially horizontally and radially outward from the lower end of the step 22, and a vertical portion 23*b* substantially parallel to the axial direction, extending to the radially outer end (upper end) of the bending part 23. Further, referring to FIG. 9, in the regions corresponding to sides 24*b*, the curvature radius R2 between the vertical portion 23*b* of the bending part 23 and each of the flat plates 25 is 0.3 mm, namely R2=0.3 mm, but not limited thereto.

In this embodiment, the outer periphery, including the radially outer end, of the bending part 23 has a regular octagonal shape as an example, having eight corners 24*a* and eight sides 24*b*, each of which extends between two circumferentially adjacent corners 24*a*. The curvature radius of the corners 24*a* and the curvature radius of the sides 24*b* are the same R1 less than or equal to 1 mm. The flat plates 25 define the circumference of a perfect circle passing the radially outer end (upper end) of each of the corners 24*a*. Thus, a radial length of each flat plate 25 extending radially outward from the radially outer end of the bending part 23 is substantially zero (or slight in some cases) at each corner 24*a* and becomes longer gradually from each corner 24*a* to the midpoint (hereinafter referred to as "side midpoint") 24*c* (see FIG. 5) of each side 24*b* between both corners 24*a* in the circumferential direction, becoming longest at the side midpoint 24*c*. In other words, a length of each flat plate 25 extending from each side 24*b* is longest at the midpoint of each side 24*b* and gradually reduced towards both corners 24*a* adjacent to the corresponding side. A length of each flat plate 25 extending from each side 24*b* is a length in the direction perpendicular to each side 24*b*. The B-B lines in FIGS. 1 and 5 pass side midpoints 24*c*.

When the button back 10, the shell cap 2 and the insert 3 are assembled into the button 1, the barrel core 3*a* of the insert 3 is inserted in the cylindrical part 11 of the button back 10, the mall diameter portion 3*d* is protruded through the opening 12 of the cylindrical part 11. Thereby, the head core 3*b* of the insert 3 is disposed on the base 21 of the umbrella part 20 of the button back 10. From this state, the shell cap 2 is attached to the umbrella part 20 of the button back 10 from the upper side of the head core 3*b* of the insert 3. That is, the bending part 2*b* of the shell cap 2 is bent downward from the radially outward end of the disk part 2*a* and deformed to be attached to the bending part 23 of the umbrella part 20 of the button back 10 from the radially outer side. At this time, since the radially outer end of the umbrella part 20 with the flat plates 25 has a perfect round shape, the bending part 2*b* of the shell cap 2 is bent from the disk part 2*a* in a manner of the perfect round shape. Thus, the front surface of the button 1 becomes a beautiful circle. Attached states of the bending part 2*b* of the shell cap 2 are different between in the corners 24*a* and in the sides 24*b* of the bending part 23.

Figure 8:
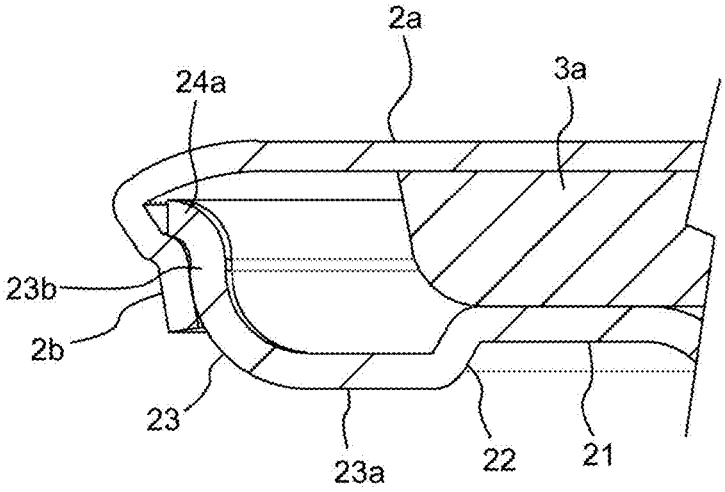
FIG. 8 is an enlarged view showing an attached state of the shell cap in a cross section corresponding to one of the corners of the bending part of the umbrella part.
Figure 9:
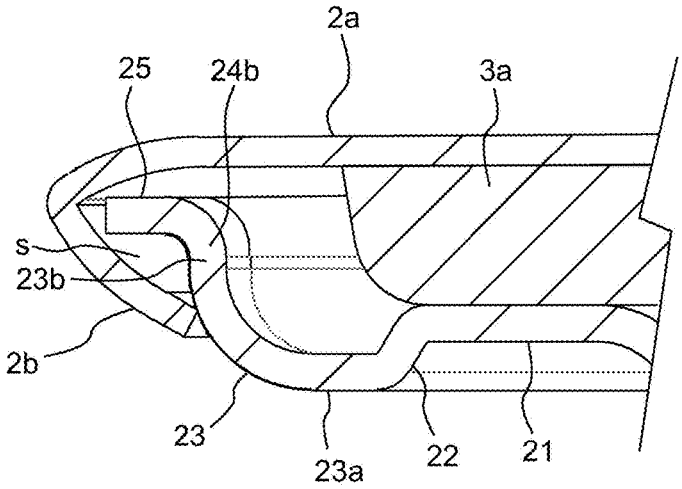
FIG. 9 is an enlarged view showing an attached state of the shell cap in a cross section corresponding to the midpoint of one of the sides of the bending part of the shell cap.

FIG. 8 is an enlarged view showing an attached state of the bending part 2*b* of the shell cap 2 in a cross section corresponding to one of the corners 24*a* of the bending part 23. FIG. 9 is an enlarged view showing an attached state of the bending part 2*b* of the shell cap 2 in a cross section corresponding to the midpoint 24*c* of one of the sides 24*b* of the bending part 23. In this embodiment, the lower end of the attached bending part 2*b* of the shell cap 2 is in contact with the regular octagonal outer periphery of the bending part 23 of the button back 10. The lower end of the bending part 2*b* extends to slightly lower than the vertical portion 23*b* of the bending part 23 but does not extend to the horizontal portion 23*a*. The bending angle of the bending part 2*b* of the shell cap 2 with respect to the disk part 2*a* is substantially the smallest at each of the corners 24*a* without the flat plate 25, while the angle is substantially the largest at each of the side midpoint 24*c* at which the radial length of each of flat plates 25 is longest. In this way, the attached states of the bending part 2*b* of the shell cap 2 change alternately in the circumferential direction with the corners 24*a* and the sides 24*b*. Thereby, once the shell cap 2 is attached to the umbrella part 20 of the button back 10, the cap 2 is hard to be rotated with respect to the umbrella part 20.

With reference to FIG. 8, the bending part 2*b* of the shell cap 2 is substantially in surface-contact with the vertical portion 23*b* in the cross section corresponding to each of the corners 24*a* of the bending part 23. On the other hand, as shown in FIG. 9, in the cross section corresponding to each of the side midpoints 24*c* of the bending part 23, there is a gap s between the bending part 2*b* of the shell cap 2 and the vertical portion 23*b*, and the bending part 2*b* is substantially not in contact with the vertical portion 23*b* or the lower end of the bending part 2*b* is in point-contact with the vertical portion 23*b*. In this way, by making the bending part 2*b* of the shell cap 2 in surface contact with the vertical portion 23*b* of the bending part 23 at the circumferential locations corresponding to the respective corners 24*a* of the bending part 23. Hence, it is expected that a function of preventing the shell cap form being rotated with respect to the umbrella part of the button back 10 will further enhance.

As can be seen from FIG. 1 showing the bottom of the button 1 and FIGS. 2 and 3, the radially inner end 2*c* of the attached bending part 2*b* of the shell cap 2 is in contact with, in the whole circumferential direction, the corners 24*a* and the sides 24*b* of the bending part 23 of the button back 10. In other words, at least radially outer end portions of the corners 24*a* and the sides 24*b* are covered between the circle defined by the radially outer end of the flat plates 25 of the umbrella part 25 of the button back 10 and the circle defined by the radially inner end 2*c* of the bending part 2*b* of the shell cap 2 after being attached to the bending part 23 of the button back 10 in the whole circumferential direction. Therefore, the shell cap 2 can be securely attached.

Figure 10:
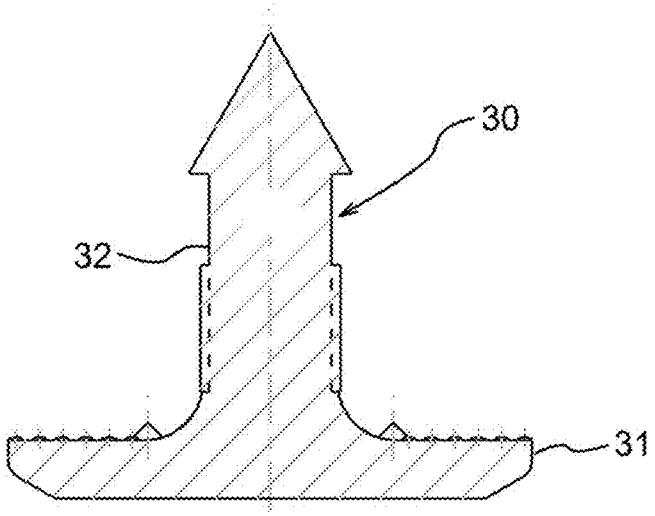
FIG. 10 shows a cross sectional view of a button fastener, which is used for mounting the button to a fabric.

FIG. 10 is a cross sectional view of the above-mentioned button fastener 30, which is used for mounting the above-described button 1 to a fabric of jeans or the like (not shown). The button fastener 30 comprises a disk-like base 31 and a shank 32 extending upward from a center region of the base 31, the shank 32 having a sharp tip. When the button 1 is mounted to a fabric, logos or the like on the front surface of the button 1 is oriented in a predetermined circumferential orientation. Then, the shank 32 of the button fastener 30 is passed through a fabric and then is inserted into the engagement space 3*c* of the insert 3 of the button 1. Thereby, the button 1 is fixed in the fabric. Since a variety of embodiments of inserts for buttons and button fasteners are known, the insert 3 and the button fastener 30 are merely one example for those.

In the above embodiment, an example is cited where the outer periphery of the bending part 23 of the umbrella part 20 is a regular octagon, but the present invention is not limited thereto. The outer periphery of the bending part may be a triangle, a quadrangle, a pentagon, a hexagon, a decagon, or a dodecagon or the like.

REFERENCE SIGNS LIST

1 button
1*a* cylindrical barrel
1*b* head
2 shell cap
2*a* disk part
2*b* bending part (second bending part)
3 insert
10 button back
11 cylindrical part
20 umbrella part
23 bending part (first bending part)
23*b* vertical portion
24*a* corner
24*b* side
25 flat plate
30 button fastener
s gap

The invention claimed is:

1. A metallic button back comprising a cylindrical part and an umbrella part extending radially outward from one axial end of the cylindrical part, wherein the umbrella part includes a first bending part which extends radially outward from the one axial end of the cylindrical part and then bends on the opposite side of the cylindrical part, wherein an outer periphery, including a radially outer end, of the first bending part has a polygonal shape including at least three corners and sides which extend between two circumferentially adjacent corners, wherein the umbrella part includes flat plates extending radially outward from the radially outer end, corresponding to the sides, of the first bending part.

2. The button back according to claim 1, wherein the flat plates define a circumference of a perfect circle passing each of the corners.

3. The button back according to claim 1, wherein the outer periphery of the first bending part has a polygonal shape including eight to twelve corners.

4. The button back according to claim 1, wherein the first bending part has a curvature radius less than or equal to 1 mm.

5. The button back according to claim 1, wherein a length of each of the flat plates extending from the first bending part is longest at the midpoint of each of the sides and gradually reduced towards both corners at both ends of each of the sides.

6. The button back according to claim 1, wherein the button back is made of aluminum or aluminum alloy.

7. A metallic button including a metallic button back and a metallic shell cap, which is attached to the button back, wherein the button back comprises a cylindrical part and an umbrella part extending radially outward from one axial end of the cylindrical part, wherein the umbrella part includes a first bending part which extends radially outward from the one axial end of the cylindrical part and then bends on the opposite side of the cylindrical part, wherein an outer periphery, including a radially outer end, of the first bending part has a polygonal shape including at least three corners and sides which extend between two circumferentially adjacent corners, wherein the umbrella part includes flat plates extending radially outward from the radially outer end, corresponding to the sides, of the first bending part, wherein the shell cap comprises a disk part defining a front surface of the button and a second bending part, which is bent from the radially outward end of the disk part to be attached to a radially outer end portion of the umbrella part of the button back, wherein a degree of bending of the second bending part of the shell cap is greater at each of the sides of the first bending part than at each of the corners.

8. The button according to claim 7, wherein the flat plates define a circumference of a perfect circle passing each of the corners.

9. The button according to claim 7, wherein attached states of the second bending part of the shell cap change alternately in the circumferential direction.

10. The button according to claim 7, wherein bending angles of the second bending part of the shell cap are different between in portions of the second bending part corresponding to the sides and in portions thereof corresponding to the corners, and wherein, in the portions corresponding to the sides, there is a gap between the second bending part and the sides.

11. The button according to claim 7, wherein the first bending part includes vertical portion substantially parallel to the axial direction of the button back, the vertical portion extending to the radially outer end of the first bending part, and wherein the second bending part of the shell cap is at least partially in contact with the vertical portion.

* * * * *